US005441777A

United States Patent [19]

Howell

[11] Patent Number: 5,441,777

[45] **Date of Patent: * Aug. 15, 1995**

[54] SCREEN OR PANEL WITH MARBLES SANDWICHED BETWEEN GRIDS

[76] Inventor: David Howell, 333 Hook Rd., Katonah, N.Y. 10536

[ * ] Notice: The portion of the term of this patent subsequent to Apr. 6, 2010 has been disclaimed.

[21] Appl. No.: 83,176

[22] Filed: Jun. 29, 1993

[51] Int. Cl.[6] ..... B44F 1/00

[52] U.S. Cl. ..... 428/11; 428/14; 428/117

[58] Field of Search ..... 428/11, 117, 12, 14; 40/124.4, 152, 152.1, 156

[56] References Cited

U.S. PATENT DOCUMENTS

| | | | |
|---|---|---|---|
| D. 113,000 | 1/1939 | Justema | D6/300 X |
| 268,870 | 12/1882 | Currier | 428/14 X |
| 369,410 | 9/1887 | Pratt | 40/152 X |
| 501,262 | 7/1893 | Walker | 40/152.1 |
| 1,202,589 | 10/1916 | Roosman | 40/152.1 |
| 4,214,390 | 7/1980 | Kluiters | 428/11 X |
| 4,707,937 | 11/1987 | Astolfi | 40/156 X |
| 5,199,200 | 4/1993 | Howell | 40/152 |

*Primary Examiner*—Henry F. Epstein
*Attorney, Agent, or Firm*—Trapani & Molldrem

[57] ABSTRACT

A decorative or structural panel is formed of an array of spheroids of transparent or translucent material held in place in a grid member. This can be front and back grid members with the spheroids sandwiched therebetween. The panel can employ a semirigid grid member, or the grid can be molded in place around the spheroids.

11 Claims, 5 Drawing Sheets

SCREEN OR PANEL WITH MARBLES SANDWICHED BETWEEN GRIDS

BACKGROUND OF THE INVENTION

This invention relates to decorative displays and panels, such as stained glass windows and mosaic walls, and is more particularly concerned with a novel arrangement of glass spheres, beads, or similar elements in a matrix or framework to produce an attractive visual effect.

Glass panels are typically constructed of colored glass sections which are joined to one another by lead strips. These are typically found in church windows, Tiffany lamp shades, or other such structures. These stained glass constructions tend to consume a large quantity of skilled labor to construct, and it is difficult to effect repairs if any of the glass breaks. Other panels, e.g. formed of colored transparent plastic, have to be constructed in large quantities to obtain manufacturing economies. However, this technique requires expensive manufacturing set-up, and cannot be used to produce custom architectural panels for individual applications.

OBJECTS AND SUMMARY OF THE INVENTION

Accordingly, it is an object of this invention to provide a structure which produces a visual effect that was unachievable in the prior art.

It is a more specific object to provide a structural panel or decorative object which incorporates transparent or translucent elements that play on the aesthetic effects of light in the environment.

It is another object to provide an economical structure which achieves this novel visual effect.

According to an aspect of the invention a structural panel of elegantly simple construction is provided, and combines the attributes of beauty and ruggedness. The decorative structural panel comprises a structural matrix that defines an array of grid openings; glass spheres, wood, metal, ceramic objects of various shapes, stones, or shells (together referred to as beads or bead members) are situated in the array of grid openings of the matrix. At least a portion of each bead member is held through the front surface or front and rear surfaces of the matrix.

In one embodiment the matrix can be formed from a front grid member and a rear grid member, with the bead members being sandwiched between them. There are grid openings formed either in the front grid member alone or in both the front and rear grid members.

A frame can be situated along the side edges or peripheral edges of the panel either between the edges of the front and rear grid members, or else over them.

In yet another embodiment, the matrix can be a one-piece member formed of a semi-rigid material, e.g., a plastic resin, with pre-formed cavities or sockets arranged in the member. Each of the cavities is exposed at one or both surfaces of the semi-rigid plastic member, and the glass spheres or other members are installed into respective ones of the sockets or cavities. The matrix can have an undercut flange at each grid opening which resiliently deforms to allow the bead members to be inserted, but then firmly retains the bead members in the cavities. In still another version, the matrix can be a injected or cast around the glass spheres or other bead members. In such case the matrix material can be generally rigid plastic material, a metal alloy with a low to moderate melting point, plaster, concrete, or other suitable castable or moldable material.

The above and many other objects, features, and advantages of this invention will be described in detail with reference to the preferred embodiment, which should be read in conjunction with the accompanying Drawing:

DETAILED DESCRIPTION OF THE PREFERRED EMBODIMENTS

Figure 1:
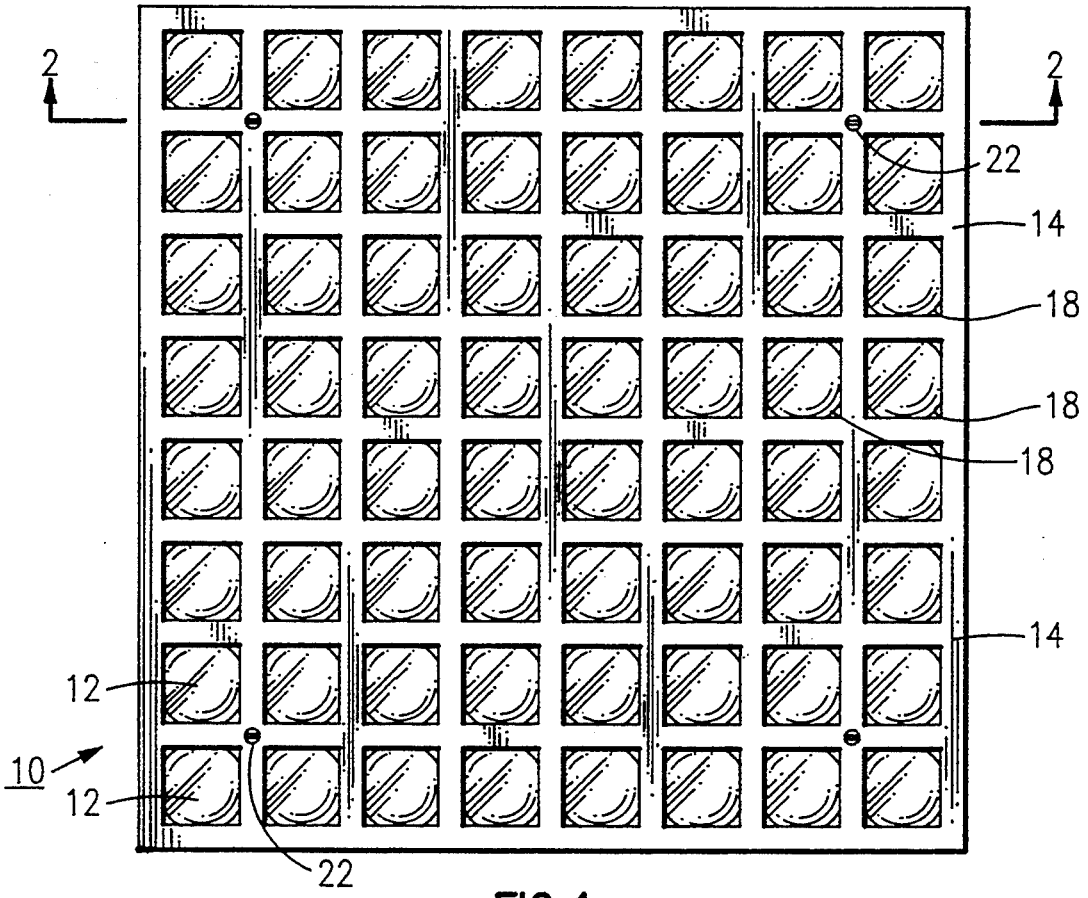
FIG. 1 is a front elevation of a decorative or structural panel according to one embodiment of my invention.
Figure 2:
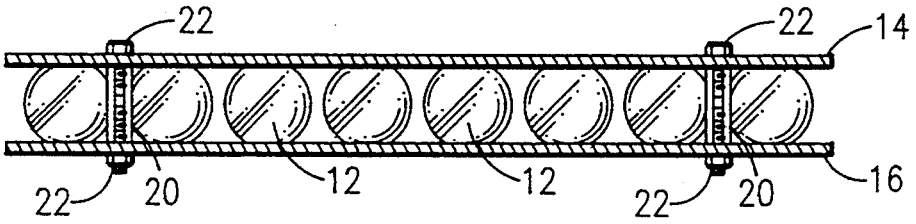
FIG. 2 is a sectional view taken at a 2—2 of FIG. 1.

FIGS. 1 and 2 illustrate one possible embodiment of my invention, and this is offered as an example of many possible variations. The panel need not be of any specific size or shape, and although this panel is shown as flat, the panel could have curvature on one axis (i.e, cylindrical curvature) or on two axes (i.e., spherical curvature).

In FIGS. 1 and 2 the panel 10 is formed of a sandwich of an array of balls or spheroids 12 disposed between a front grid member 14 and a rear grid member 16. The grid members 14,16 each have an array of holes or grid openings 18. In this embodiment the holes are in a rectangular grid, but the holes could be arranged in another pattern or in a random fashion without departing from the invention. At least a portion of each of the balls or spheroids 12 is exposed through a respective one of the grid openings 18. The two grid members 14, 16 are held together by suitable fastening means, in this example by female threaded posts 20 and pairs of male threaded screws 22. Most favorably the balls or spheroids can be transparent or translucent glass spheres, e.g., marbles. These spheroids are arranged into an aesthetically pleasing design. In a large enough panel, where a sufficient number of a spheroids in the array permit a representational arrangement, i.e., a picture can be created in the manner of a mosaic. This can be back lit, in the manner of a stained-glass church window, to produce a dramatic effect.

A plurality of small panels can be constructed and tiled together to cover a portion of a wall, or else a single large panel can be constructed.

Also, rather than spherical members like the balls 12, beads or shapes of arbitrary design, or sea shells can be arranged in this manner between the grid members 14, 16.

Figure 3:
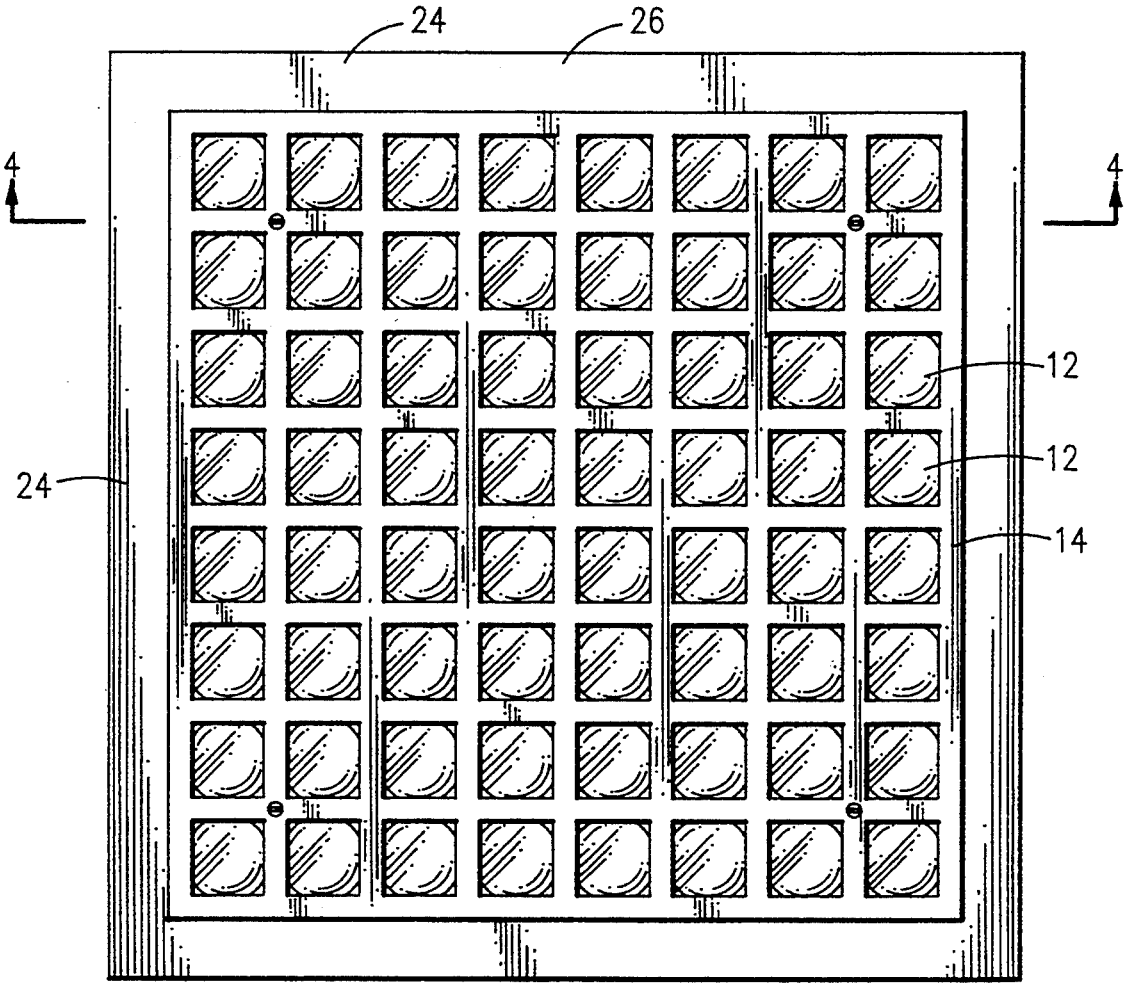
FIG. 3 is a front elevation of another embodiment of the invention.
Figure 4:
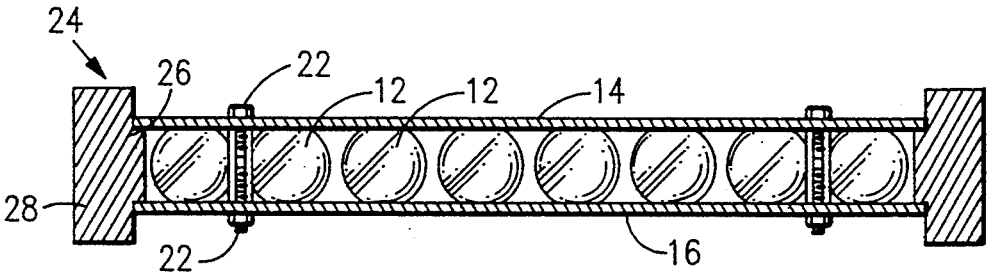
FIG. 4 is a sectional view taken at 4—4 of FIG. 3.
Figure 5:
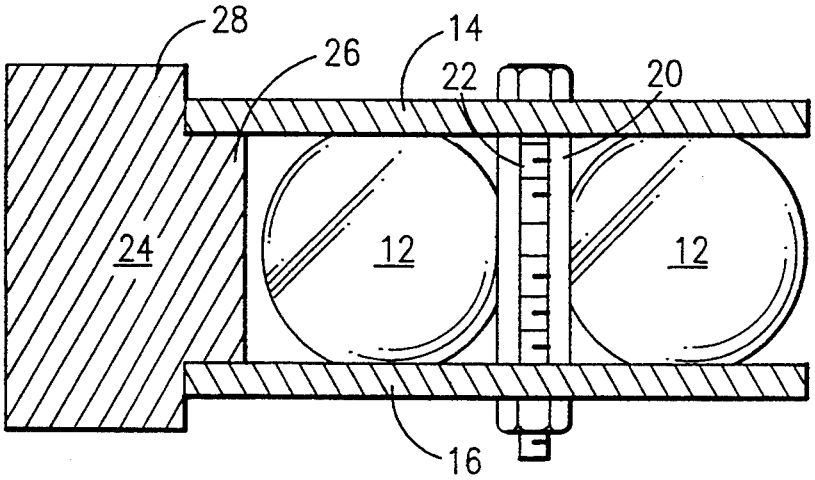
FIG. 5 is an enlargement of a portion of FIG. 4.

An alternative arrangement is shown in FIGS. 3, 4, and 5, in which similar elements are identified by the same reference numbers, and a detailed description of such elements will not be repeated here.

In this embodiment a frame member 24 serves as a border for the grid members 14, 16 and also provides structural support. The frame member is T-shaped in cross section with a narrower flange portion 26 that is captured between edges of the grid members 14, 16 and a wide portion 28 that protrudes ahead of the front grid member 14 and behind the rear grid member 16.

Figure 6:
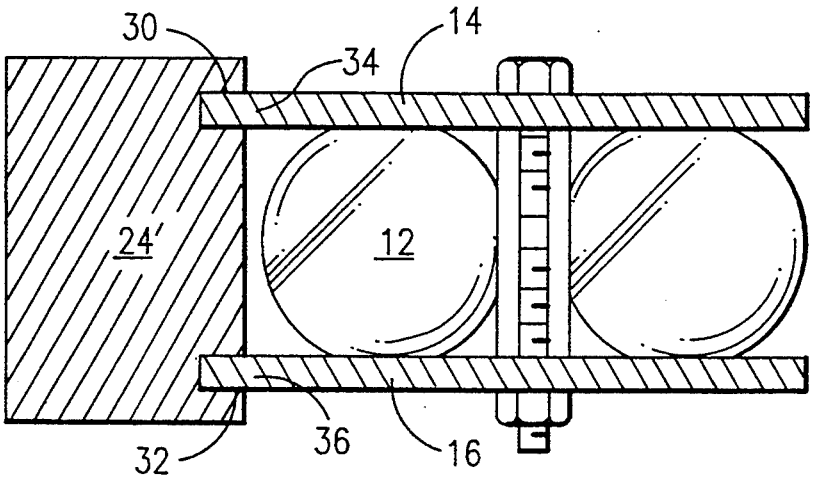
FIGS. 6 and 7 are variations of the embodiment of FIGS. 3 to 5.
Figure 7:
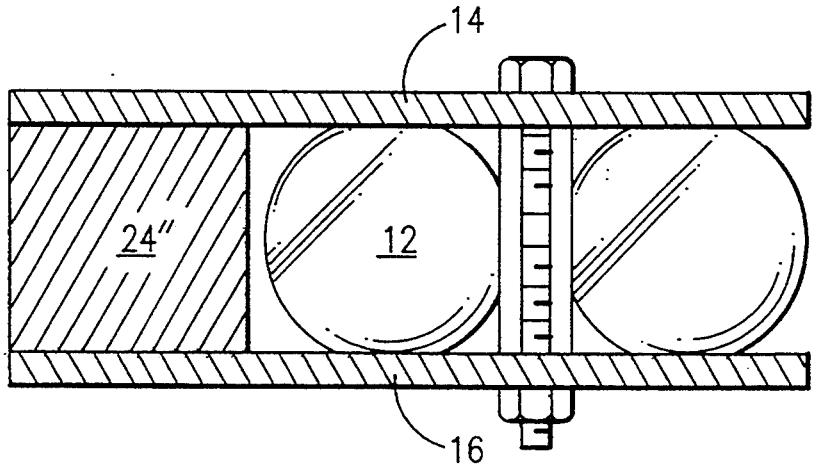

Further alternative embodiments are shown in FIGS. 6 and 7, where similar parts are again identified with the same reference numbers. Where such part is modified, a prime (FIG. 6) or double prime (FIG. 7) is added.

In FIG. 6, a frame member 24' is generally rectangular in cross section, but has front and back slots 30, 32 which capture respective edges 34, 36 of the front and back frame members 14, 16.

In FIG. 7 a frame member 24'' is entirely sandwiched between enlarged edge portions 38,40 of the front and back grid members 14, 16.

Figure 8:
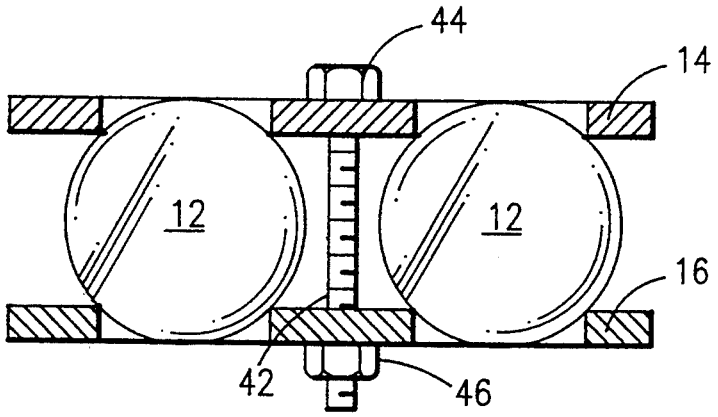
FIGS. 8 and 9 are partial sectional views showing alternative attaching means.
Figure 9:
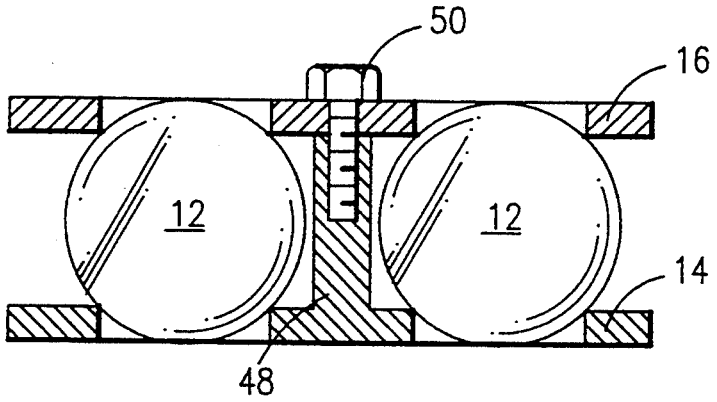

FIGS. 8 and 9 illustrate alternative fastening means to the screws 22 and posts 22 of FIGS. 1–4. In FIG. 8, a threaded post 42 having a head 44 penetrates the front and back grid members 14, 16 and is fastened by a nut 46 onto the back side of the grid member 16. In FIG. 9 a female threaded tubular post 48 is incorporated into the front grid member 14 and the rear grid member 16 is attached by a male threaded screw 50.

Figure 10:
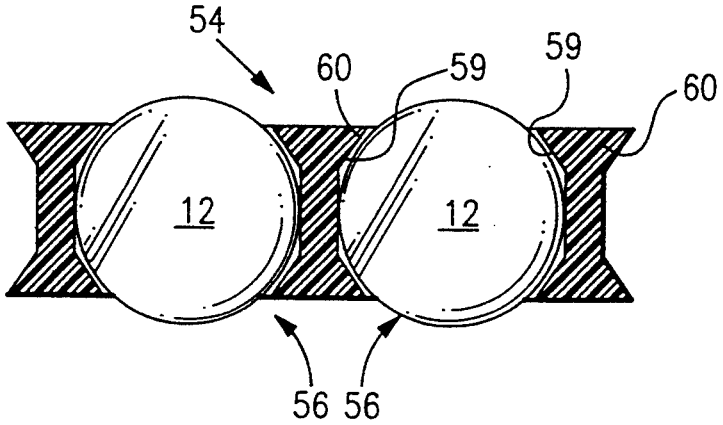
FIG. 10 is a partial sectional view of another embodiment.

FIG. 10 illustrates another embodiment in which the array of spheroids 12, are retained in a flexible but semi-rigid grid member 54. The grid member 54 has an array of sockets 56 each holding a respective one of the spheroids 12. The sockets are defined by walls 58 of the semi-rigid material with annular flanges 60 at the front and rear of each of the grid openings or sockets 56. The flanges are angulated to define an undercut entry 59 to each of the sockets. These retain the spheroids 12 in place, but are sufficiently yieldable to permit a spheroid to be inserted into the socket, and to permit the spheroids to be removed and replaced if need be.

Figure 12:
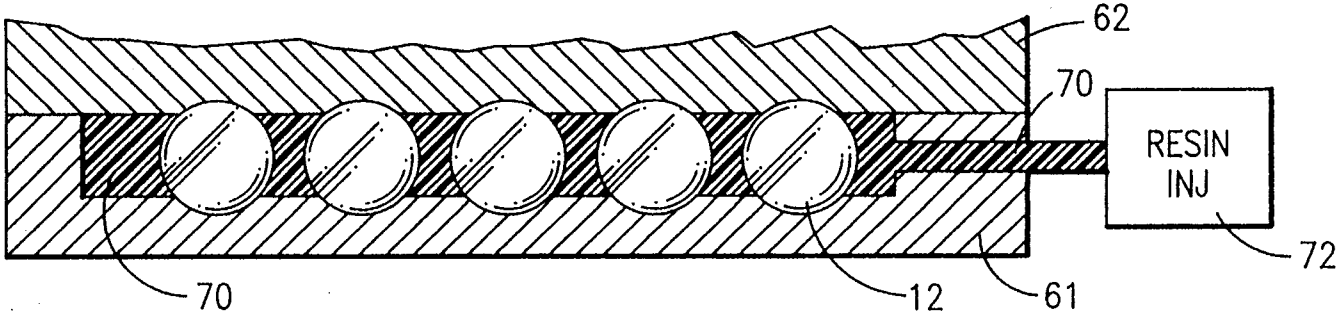
Figure 13:
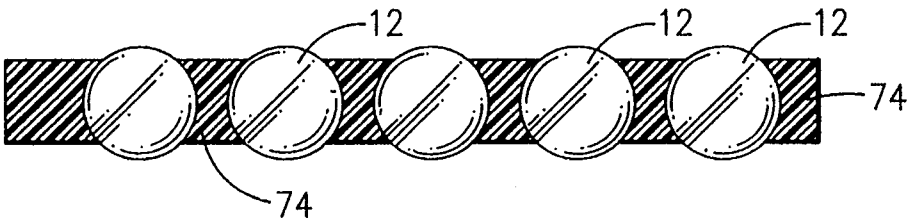

The panel of this invention can be created by molding the grid member or member in place around a suitable array of glass spheres or other bead members, and one possible technique for carrying this out will be explained with reference to FIGS. 11, 12 and 13.

Figure 11:
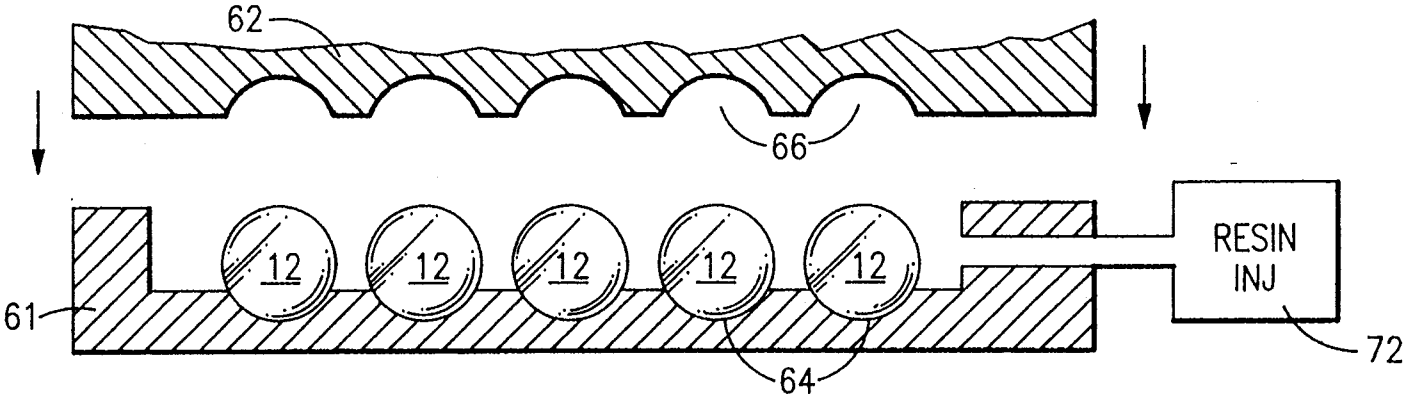
FIGS. 11, 12, and 13 are sectional views illustrating one technique of forming the panels of this invention, and the panel yielded by this technique.

As shown very schematically in FIG. 11. a two part mold is provided including a base 61 and a cover 62. Each of the base 61 and cover 62 has spherical recesses 64, 66 which mate with the surfaces of the glass spheroids 12.

First the spheroids 12 are arranged in a predetermined pattern in the base 61. Then the cover 62 descends as shown in FIG. 12. This defines a closed space 68 containing the array of spheroids.

A suitable softened synthetic resin 70 is injected by a resin injector 72 into the space 68. Trapped air and gases are permitted to escape through not-shown vents. The resin is injected until all of the space 68 not occupied with the spheroids is filled with the plastic resin 70. Then the workpiece is permitted to harden and is removed from the mold. This yields a panel formed of the spheroids 12 captured within a molded plastic grid 74, as shown in cross section in FIG. 13.

As an alternative technique a softened or molten glass can be flowed into a mold around an array of spheroids, or a molten metal such as pewter can be used for this. Also, opaque beads can be employed in place of some of the glass beads for a different visual effect.

While this invention has been described in detail in reference to a few selected embodiments it should be understood that the invention is not limited to those embodiments. Rather, many modifications and variations would become apparent to persons skilled in the art without departing from the scope and spirit of this invention, as defined in the appended claims.

What is claimed is:

1. A decorative structural panel comprising a matrix defining an array of grid openings and an array of bead members situated respectively in said grid openings with at least a portion of each of said bead members being exposed through its respective grid opening, said matrix including bead retaining means for retaining said bead members in said openings and said means allowing light to pass through said bead members in said matrix.

2. A decorative structural panel of claim 1 wherein said matrix includes a front grid member formed of a rigid sheet having an array of said grid openings formed therein, and said bead retaining means includes a rear grid member having a similar array of said grid openings therein, said front and rear grid members sandwiching said bead members therebetween.

3. The decorative structural panel of claim 1 wherein said matrix includes a front grid member having said grid openings formed therein and said bead retaining means includes a rear grid member having similar grid openings formed therein, with said bead members being sandwiched between said front and rear grid members; and a frame situated on peripheral edges of the paired front and rear grid members.

4. The decorative structural panel of claim 1 wherein said matrix includes a one-piece flat grid member formed of a semi-rigid material having an array of cavities therein to receive respective ones of said bead members, and each of said cavities reaching to a front face of the matrix to define a respective grid opening in said front face.

5. The decorative structural panel of claim 4 wherein said retaining means includes, at the front face of each said cavity, an undercut front flange portion to retain the respective bead member therein.

6. The decorative structural panel of claim 1 wherein said bead members are transparent or translucent spheroids.

7. A decorative structural panel comprising an array of bead members, and a grid of molded material which is molded in place around said array of bead members such that said grid permits light to pass therethrough and retains said bead members in place.

8. The decorative structural panel of claim 7 wherein said bead members include transparent or translucent spheroids.

9. A decorative structural panel which comprises a flat grid member formed of a semi-rigid material having an array of sockets formed therein, each of said sockets reaching to a front face of the grid member to define a respective grid opening; and a plurality of bead members situated respectively in said grid openings with at least a portion of the bead members being visually exposed through its respective grid opening.

10. The decorative structural panel of claim 9 wherein at front and rear faces of the grid member said sockets each have an undercut front flange portion and an undercut rear flange portion, respectively, to retain the respective bead member therein.

11. The decorative structural panel of claim 9 wherein said bead members include transparent or translucent spheroids.

* * * * *

UNITED STATES PATENT AND TRADEMARK OFFICE

CERTIFICATE OF CORRECTION

PATENT NO. : 5,441,777

DATED : Aug. 15, 1995

INVENTOR(S) : David Howell

It is certified that error appears in the above-indentified patent and that said Letters Patent is hereby corrected as shown below:

On title page, at [*] Notice:
"Apr. 6, 2010" should read --July 24, 2012--

Signed and Sealed this

Twenty-third Day of April, 1996

Bruce Lehman

*Attest:*

BRUCE LEHMAN

*Attesting Officer*

*Commissioner of Patents and Trademarks*

US005441777C1

(12) REEXAMINATION CERTIFICATE (4729th)

United States Patent

Howell

(10) Number: US 5,441,777 C1

(45) Certificate Issued: Feb. 4, 2003

(54) SCREEN OR PANEL WITH MARBLES SANDWICHED BETWEEN GRIDS

(75) Inventor: David Howell, 333 Hook Rd., Katonah, NY (US) 10536

(73) Assignee: David Howell, Katonah, NY (US)

Reexamination Request:
No. 90/005,366, May 24, 1999

Reexamination Certificate for:

| | |
|---|---|
| Patent No.: | **5,441,777** |
| Issued: | **Aug. 15, 1995** |
| Appl. No.: | **08/083,176** |
| Filed: | **Jun. 29, 1993** |

( * ) Notice: This patent is subject to a terminal disclaimer.

Certificate of Correction issued Apr. 23, 1996.

(51) Int. Cl.[7] ..... B44F 1/00

(52) U.S. Cl. ..... 428/11; 428/14; 428/117

(58) Field of Search ..... 428/11, 12, 14, 428/17, 117; 40/124.4, 152, 152.1, 156

(56) References Cited

U.S. PATENT DOCUMENTS

| | | | | |
|---|---|---|---|---|
| 1,263,065 | A | 4/1918 | Johanson | |
| 1,933,657 | A | 11/1933 | Chubb | 40/133 |
| 2,094,549 | A | 9/1937 | Fisher | 41/10 |
| 2,151,236 | A | 3/1939 | Schwartz et al. | 359/453 |
| 2,680,501 | A | 6/1954 | Cunningham | 189/82 |
| 3,127,302 | A | 3/1964 | Bunting | 161/16 |
| 4,035,690 | A | 7/1977 | Roeber | 315/169 |
| 4,541,812 | A | 9/1985 | Katsumata | 446/91 |
| 5,192,623 | A | 3/1993 | Gewelber | 428/593 |
| 5,197,256 | A | 3/1993 | Martin | 52/808 |
| 5,217,776 | A | 6/1993 | Tilby | 428/61 |
| 5,228,937 | A | 7/1993 | Passeno | 156/299 |
| 5,233,810 | A | 8/1993 | Jennings | 52/745.19 |
| 5,391,105 | A | 2/1995 | Jones | 446/219 |
| 5,759,924 | A | 6/1998 | Sahlin | 442/60 |
| 5,813,172 | A | 9/1998 | McNally | 52/2.25 |
| 5,827,458 | A | 10/1998 | Meadows | 264/46.2 |
| 5,842,314 | A | 12/1998 | Porter | 52/309.7 |
| 5,861,119 | A | 1/1999 | Merser | 264/46.4 |
| 5,863,638 | A | 1/1999 | Harvey | 428/195 |
| 5,900,304 | A | 5/1999 | Owens | 428/182 |
| 5,946,878 | A | 9/1999 | Grund et al. | 52/630 |
| 5,950,397 | A | 9/1999 | Ginn et al. | 52/724.14 |
| 5,955,207 | A | 9/1999 | Lederich et al. | 428/660 |

OTHER PUBLICATIONS

U.S. Trademark Reg. 2,085,269—LIGHTscreen.

*Primary Examiner*—Deborah Jones

(57) ABSTRACT

A decorative or structural panel is formed of an array of spheroids of transparent or translucent material held in place in a grid member. This can be front and back grid members with the spheroids sandwiched therebetween. The panel can employ a semirigid grid member, or the grid can be molded in place around the spheroids.

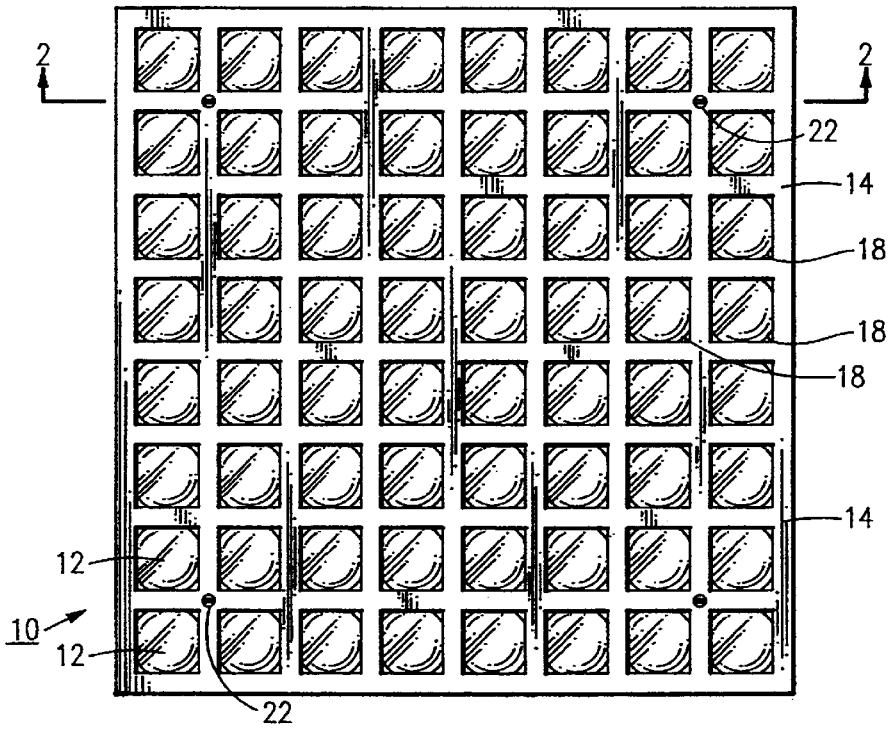

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Columm 2, lines 38–59:

In FIGS. 1 and 2 the panel 10 is formed of a sandwich of an array of balls or spheroids 12 disposed between a front grid member 14 and a rear grid member 16. The grid members 14,16 each have an array of holes or grid openings 18. In this embodiment the holes are in a rectangular grid, but the holes could be arranged in another pattern [or in a random fashion] without departing from the invention. At least a portion of each of the balls or spheroids 12 is exposed through a respective one of the grid openings 18. The two grid members 14, 16 are held together by suitable fastening means, in this example by female threaded posts 20 and pairs of male threaded screws 22. Most favorably the balls or spheroids can be transparent or translucent glass spheres, e.g., marbles. These spheroids are arranged into an aesthetically pleasing design. In a large enough panel, where a sufficient number of spheroids in the array permit a representational arrangement, i.e., a picture can be created in the manner of a mosaic. This can be back lit, in the manner of a stained-glass church window, to produce a dramatic effect.

AS A RESULT OF REEXAMINATION, IT HAS BEEN DETERMINED THAT:

The patentability of claims 7, 8, 10 and 11 is confirmed.

Claim 9 is cancelled.

Claims 1–3 are determined to be patentable as amended.

Claims 4–6, dependent on an amended claim, are determined to be patentable.

New claims 12–22 are added and determined to be patentable.

1. A decorative structural *wall* panel comprising a matrix defining an array of grid openings and an array of bead members situated respectively in said grid openings with at least a portion of each of said bead members being exposed through its respective grid opening, said matrix including bead retaining means for retaining said bead members in said openings and said means allowing light to pass through said bead members in said matrix.

2. A decorative structural *wall* panel [of claim 1] *comprising a matrix defining an array of grid openings and an array of bead members situated respectively in said grid*

*openings with at least a portion of each of said bead members being exposed through its respective grid opening, said matrix including bead retaining means for retaining said bead members in said openings and said means allowing light to pass through said bead members in said matrix;* wherein said matrix includes a front grid member formed of a rigid sheet having an array of said grid openings formed therein, and said bead retaining means includes a rear grid member having a similar array of said grid openings therein, said front and rear grid members sandwiching said bead members therebetween.

3. [The] *A* decorative structural panel [of claim 1] *comprising a matrix defining an array of grid openings and an array of bead members situated respectively in said grid openings with at least a portion of each of said bead members being exposed through its respective grid opening, said matrix including bead retaining means for retaining said bead members in said openings and said means allowing light to pass through said bead members in said matrix;* wherein said matrix includes a front grid member having said grid openings formed therein and said bead retaining means includes a rear grid member having similar grid openings formed therein, with said bead members being sandwiched between said front and rear grid members; and a frame situated on peripheral edges of the paired front and rear grid members.

*12. A decorative structural panel comprising a matrix defining an array of grid openings and an array of bead members situated respectively in said grid openings with at least a portion of each of said bead members being exposed through its respective grid opening, said matrix including bead retaining means for retaining said bead members in said openings and said means allowing light to pass through said bead members in said matrix, wherein said matrix includes a front grid member formed of a rigid sheet having an array of said grid openings formed therein and said bead retaining means including a similar array of said grid openings therein, said front and rear grid members sandwiching said bead members therebetween; and further including a plurality of spacers holding said front and rear grid members and positioned between said grid members at locations between said openings.*

*13. The decorative structural panel of claim 12 wherein said spacers include a post having a bore adapted to receive a threaded fastener.*

*14. The decorative structural panel of claim 12 in which said spheroids include translucent glass spheres and said spheres are arranged in the grid openings in the manner of a mosaic.*

*15. The decorative structural wall panel of claim 1 in which said bead members include translucent glass spheres, and said spheres are arranged in said grid openings in the manner of a mosaic.*

*16. The decorative structural wall panel of claim 15 wherein said spheres are arranged in a representational arrangement.*

*17. The decorative structural wall panel according to claim 1, wherein said bead members are spheroidal and the associated openings are polygons.*

*18. The decorative structural wall panel according to claim 17, wherein said openings are squares.*

*19. The decorative structural wall panel of claim 2 wherein said grid openings are polygons.*

*20. The decorative structural wall panel of claim 19 wherein said grid openings are squares.*

*21. The decorative structural panel of claim 9 wherein said sockets are sufficiently yieldable to permit one of said bead members to be inserted in the socket, and to be removed and replaced later.*

*22. The decorative structural panel of claim 3 wherein said frame is situated between the peripheral edges of the front and rear grid members.*

* * * * *